US005966563A

United States Patent [19]

Kashihara et al.

[11] Patent Number: 5,966,563

[45] Date of Patent: Oct. 12, 1999

[54] ELECTROSTATIC IMAGING DEVICE HAVING MEANS FOR REMOVING UNDESIRABLE PARTICLES FROM A BRUSH CHARGER AND TRANSCRIBING ROLLER

[75] Inventors: Mabumi Kashihara, Niigata; Toshimi Watanabe, Yamagata, both of Japan

[73] Assignee: NEC Corporation, Tokyo, Japan

[21] Appl. No.: 08/944,641

[22] Filed: Oct. 6, 1997

[30] Foreign Application Priority Data

Oct. 4, 1996 [JP] Japan ..... 8-263974

[51] Int. Cl.[6] ..... G03G 15/02; G03G 21/00

[52] U.S. Cl. ..... 399/100; 399/101; 399/175

[58] Field of Search ..... 399/100, 101, 399/127, 128, 129, 175, 234, 235, 148

[56] References Cited

U.S. PATENT DOCUMENTS

| | | | |
|---|---|---|---|
| 5,337,127 | 8/1994 | Imaue | 399/101 |
| 5,371,578 | 12/1994 | Asano et al. | 399/100 |
| 5,621,509 | 4/1997 | Karashima et al. | 399/46 |

FOREIGN PATENT DOCUMENTS

| | | |
|---|---|---|
| 5-61270 | 3/1993 | Japan . |
| 6-95520 | 4/1994 | Japan . |
| 7-261627 | 10/1995 | Japan . |
| 7-281492 | 10/1995 | Japan . |

*Primary Examiner*—Joan Pendegrass
*Attorney, Agent, or Firm*—Sughrue, Mion, Zinn, Macpeak & Seas, PLLC

[57] ABSTRACT

An electrostatic imaging device has a photoreceptor drum, an exposure unit to form a latent image on the photoreceptor, a developing unit for forming a toner pattern on the photoreceptor, a transcribing roller for electrifying the photoreceptor drum and transcribing the toner pattern onto a recording sheet, a brush charger for electrifying the photoreceptor drum, and a power supply section for applying a first negative voltage to the transcribing roller and a second negative voltage to the brush charger during a period other than an image forming period. The second voltage is lower than the first voltage in absolute value. Undesirable particles having a positive potential and attached to the brush charger is collected to the photoreceptor drum for cleaning the brush charger.

4 Claims, 6 Drawing Sheets

ELECTROSTATIC IMAGING DEVICE HAVING MEANS FOR REMOVING UNDESIRABLE PARTICLES FROM A BRUSH CHARGER AND TRANSCRIBING ROLLER

BACKGROUND OF THE INVENTION (a) Field of the Invention

The present invention relates to an electrostatic imaging device having a brush charger and, more particularly, to an electrostatic imaging device for transcribing a toner pattern on the surface of an electrostatic latent image carrier onto a recording sheet such as a recording paper, OHP (overhead projector) sheet or postcard.

(b) Description of the Related Art

Electrophotography processes is generally used in an electrostatic imaging device (often referred to simply as an "imaging device" hereinafter) such as a copying machine, facsimile, electrophotography or electrostatic printers. In the imaging device, after a photoreceptor drum (or electrostatic latent image carrier) is electrified to form an electrostatic latent image, electrified or charged toner is supplied to the surface of the photoreceptor drum As a result, the electrified toner is adhered to the photoreceptor drum having a latent image pattern thereon, to form a toner pattern for development. Recording sheet is then supplied to the surface of the photoreceptor drum in synchrony with the rotation of the photoreceptor drum while applying a bias voltage, which has an opposite polarity with respect to the toner voltage, from the rear side of the recording sheet by using a transcribing roller, thereby transcribing the toner pattern formed on the photoreceptor drum to the recording sheet. Subsequently, the toner pattern on the recording sheet is fixed to the recording sheet by using a fixing unit.

A corona charging device, which generates a corona discharge from a wire electrode, is generally used for electrifying the photoreceptor drum. A a power source is used to apply a high voltage of several kilovolts to the wire electrode for generating the corona discharge. The power source of such a high voltage is highly expensive to thereby raising the fabrication cost of the imaging device. In addition, ozone generated by the corona discharge produces an undesirable influence on the human body and the natural environment. Further, there arises a problem in that the photoreceptor drum and other units disposed around the photoreceptor drum are damaged by the corona discharge.

As an alternative for the corona charging device, a contact-type electrifying device is known which electrifies the photoreceptor drum by using a brush charger. The brush charger is classified into two categories including a planar brush of a fixed type and a roller brush of a rotational type. The fixed-type brush charger generally comprises an insulator substrate, a conductive layer fixed on the insulator substrate and applied with a bias voltage, and low-resistive brush fibers extending from the conductive layer.

The brush charger as mentioned above can solve the problems involved in the corona charging device. However, it involves another problem as described below. Specifically, in the electrostatic imaging device, the drum surface is generally subjected to abrasion by the friction between the photoreceptor drum and the developing roller, which sometime produces dispersed particles or dust charged in opposite polarity with respect to the photoreceptor drum. The friction may also generate toner particles electrified in an opposite polarity in addition to toner particles electrified in the normal polarity. These dispersed particles or toner particles charged in opposite polarity are generally firmly attached to the surface of the photoreceptor drum and are difficult to remove by using a cleaning unit.

In addition, the rotating photoreceptor drum allows these undesirable particles on the photoreceptor drum to be introduced between the fibers of the brush charger and attached firmly thereto, or allows the undesirable particles to be adhered to a contact-type transcribing member. In these cases, the photoreceptor drum is subjected to an insufficient electrified state for printing or image forming due to the undesirable particles, whereas the transcribing roller makes fog on the rear surface of the recording sheet due to the undesirable particles.

Patent Publication No. JP-B-63 (1988)-43750 proposes an electrostatic imaging device wherein the undesirable particles attached to the brush charger are efficiently removed by applying a voltage having a DC voltage component in the opposite polarity with respect to the polarity of the photoreceptor drum to the brush charger during a non-printing period (period other than an image forming period) of the imaging device, whereas applying thereto a voltage having a DC voltage component in the same polarity with respect to the photoreceptor drum during a printing period (image forming period) of the imaging device.

In the proposed imaging device, the surface of the photoreceptor drum is subjected to electrification in the opposite polarity with respect to the polarity of the drum surface during the period other than the image forming period, which provides the advantage of easier attachment of the toner to the drum surface during the period other than the image forming period of the imaging device. The easier attachment of the toner allows the undesirable particles to be removed from the brush charger for cleaning. However, it involves another problem wherein the charged toner is more firmly attached to the drum surface when the portion of the drum surface charged in opposite polarity is in contact with the toner supply member, or developing roller, after some rotation.

SUMMARY OF THE INVENTION

It is, therefore, an object of the present invention to provide an electrostatic imaging device which is capable of efficiently removing undesirable dispersed particles and toner particles adhered onto the photoreceptor drum or electrostatic latent image carrier.

The present invention provides an electrostatic imaging device comprising a cylindrical photoreceptor drum, a transcribing roller, disposed in operable relationship with the photoreceptor drum to form a nip portion therebetween for passing a recording sheet, an exposure unit for irradiating the photoreceptor drum to form a latent image thereon during an image forming period, a developing unit for supplying electrified toner to the photoreceptor drum to form a toner pattern, a brush charger, disposed in operable relationship with the photoreceptor drum, for electrifying the photoreceptor drum, and a power supply section for applying power source, the power supply section applying a first voltage to the transcribing roller and a second voltage to the brush charger during a period other than the image forming period, the second voltage being lower than the first voltage in absolute value and having a polarity which is same as a polarity of the first voltage.

In this text, if the first voltage is a negative voltage, for example, the second voltage which is of the same polarity with respect to the first voltage includes zero volt or ground potential in addition to a usual negative voltage.

In accordance with the present invention, the brush charger disposed in contact with the photoreceptor drum is applied with the second voltage during the period other than the image forming period, which enables the photoreceptor drum to attract the undesirable particles (or toner particles) charged in the opposite polarity (hereinafter referred to simply as undesirable particles) to efficiently remove the undesirable particles from the brush charger.

It is preferable that the power supply section apply the second voltage to the brush charger at the timing in relationship with the timing of the arrival of the portion of the photoreceptor drum at the brush charger.

It is also preferable that the first voltage be exchanged to a third voltage in the transcribing member before the recording sheet arrives at the nip portion during the period other than the image forming period, to remove the undesirable particles, attached to the transcribing roller and having an opposite polarity with resect to the first voltage, toward the photoreceptor drum. In this case, it is possible to reduce the fog on the recording paper generated by the transcribing member due to the undesirable particles provided from the photoreceptor drum.

The above and other objects, features and advantages of the present invention will be more apparent from the following description, referring to the accompanying drawings.

PREFERRED EMBODIMENTS OF THE INVENTION

Now, the present invention is more specifically described with reference to the accompanying drawings.

Figure 1:
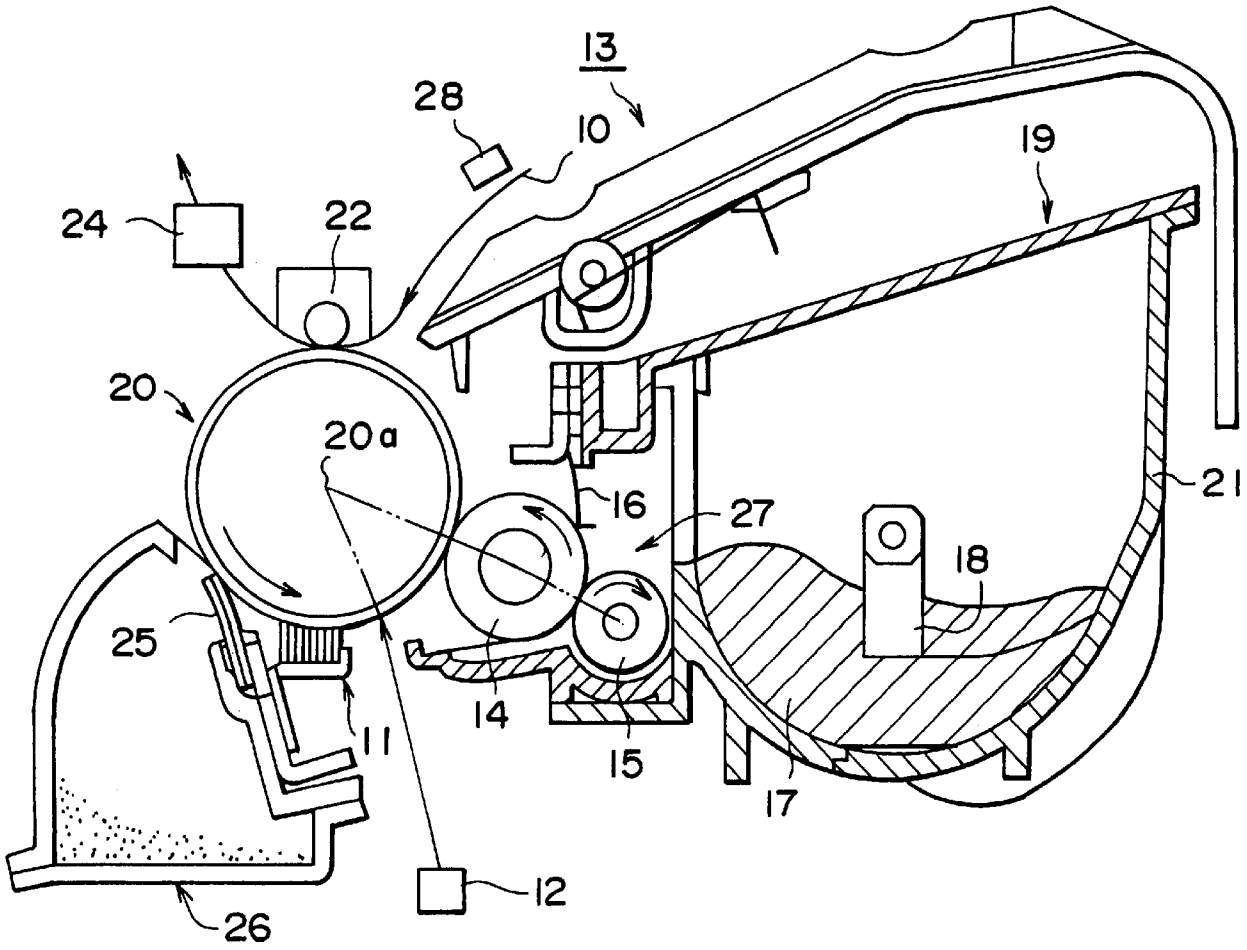
FIG. 1 is a cross-sectional view along the axis of the photoreceptor drum in an electrostatic imaging device according to an embodiment of the present invention.

Referring first to FIG. 1, an electrostatic imaging device according to an embodiment of the present comprises a waging section 13 and a drive circuit (not specifically shown) for driving the imaging section 13. The imaging section 13 comprises a developing unit 19, a photoreceptor drug (electrostatic latent image carrier) 20, and a cleaning unit 26 which are consecutively disposed as viewed along the direction of the flow of the recording sheet 10.

Above the photoreceptor drum 20, there are also provided a transcribing roller 22 for transcribing the toner pattern formed on the photoreceptor drum 20 to the recording sheet 10, a fixing unit 24 for fixing the transcribed toner pattern to the recording sheet 10 by heating and pressing, and a position sensor 28 disposed at the upstream of the transcribing roller 22 for sensing the leading edge and trailing edge of the recording sheet 10. Below the photoreceptor drum 20, there are also provided a brush charger 11 for assisting electrification of the photoreceptor drum 20 and an exposure unit 12 which has a laser or light emitting diode (LED) for scanning the surface of the photoreceptor drum 20 to form an electrostatic latent image on the drum surface based on the image data.

The developing unit 19 as a whole is opposed to the photoreceptor drum 20. The developing unit 19 comprises a toner hopper 21 having therein toner 17, a toner agitator 18, and a toner supply cheer 27 having therein a pair of toner supply roller 15 and a developing roller 14 arranged along the direction of the flow of the toner. Above the developing roller 14 within the toner supply chamber 27, there is provided a toner blade 16 having an edge disposed in slidable contact with the developing roller 14 for forming a toner layer of a predetermined thickness on the developing roller 14.

The developing roller 14 comprises a metallic roller body made of stainless steel or aluminum, and a cover film made of a flexible or elasticmaterial such as silicone rubber, polyurethane rubbery, nitrile butylene rubber, or a foam material including urethane or silicone which may be subjected to surface treatment. The toner blade 16 may be formed from a metallic thin plate such as stainless steel, phosphor bronze or new silver to have a spring function, which may be coated by silicone rubber at the edge portion thereof in contact with the developing roller 14. The toner supply roller 15 may be an insulator or conductor, and may be made of a foam material including urethane or silicone or aluminum.

The photoreceptor drum 20 is made of an aluminum tube covered by a photoreceptor filmmade of organic photoreceptor (OPC), selenium based material etc. The photoreceptor drum 20 rotates in the counter-clockwise direction as viewed in FIG. 1 around a rotational axis 20*a* thereof extending perpendicularly to the direction of the flow of the recording sheet 10.

The cleaning unit 26 comprises a scratching member 25 disposed in contact with the surface of the photoreceptor drum 20 for scratching off undesirable particles or toner particles remaining on and attached to the drum surface, to thereby drop these particles into the cleaning unit 26.

Figure 2:
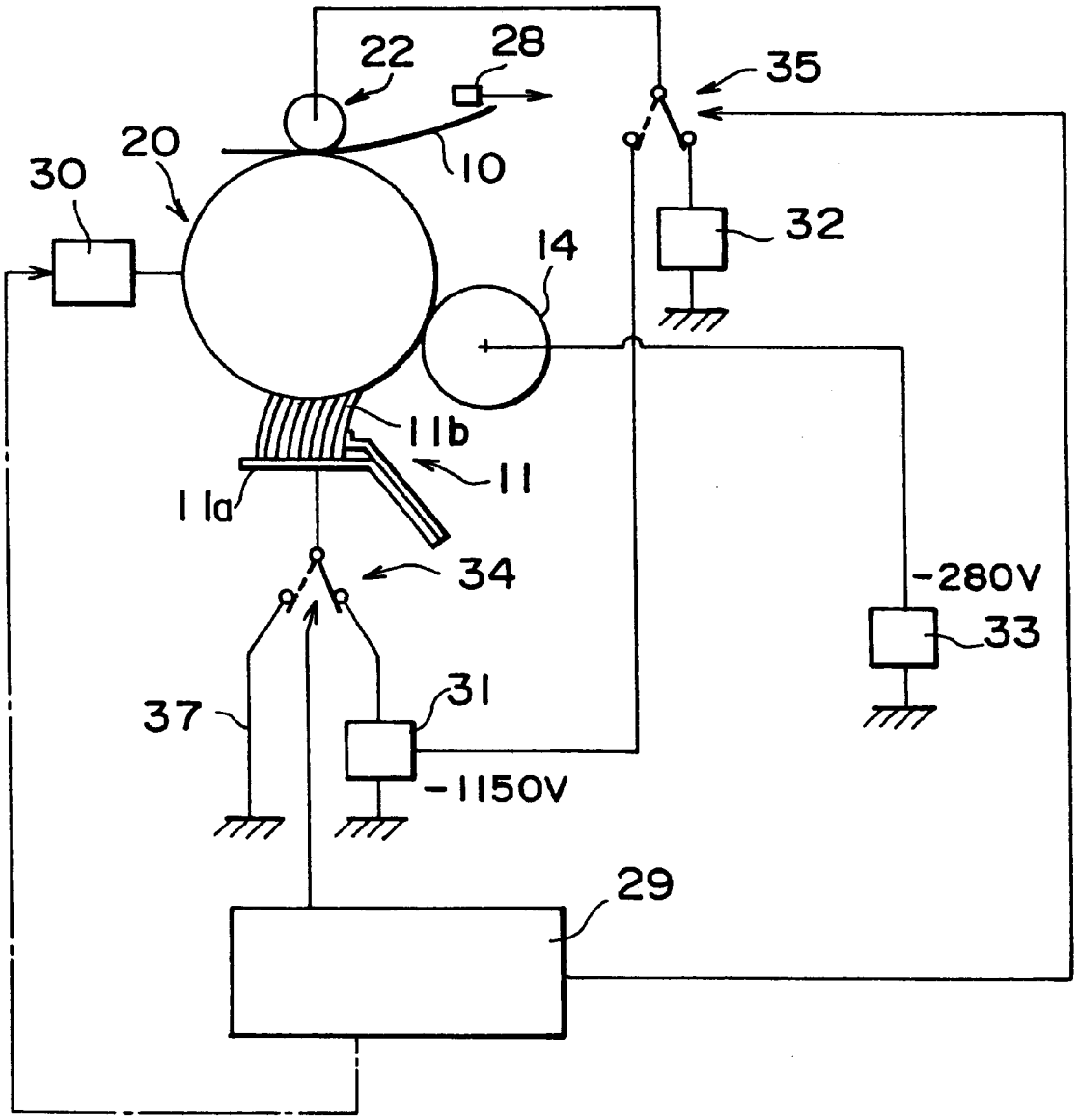
FIG. 2 is a schematic block diagram of the imaging device of FIG. 1 for showing the operation thereof.

Referring next to FIG. 2, the imaging device of FIG. 1 comprises a drive section including a control unit 29 for controlling the operation of the drive section as a whole, a motor 30 for rotating the photoreceptor drum 20, a first power source 31 for supplying a first negative voltage (−1150 volts, for example) for the transcribing roller 22 and the brush charger 11, a second power source 32 for supplying a positive voltage to the transcribing roller 22, a third power source 33 for supplying the developing roller 14 with a second negative voltage (−280 volts, for example) which has a polarity which is same as the polarity of the charged toner, a first changeover switch 34 and a second changeover switch 35.

The brush charger 11 has an operable edge which is disposed in contact with the surface of the photoreceptor drum 20 and extends parallel to the rotational axis of the photoreceptor drum 20. The brush charger 11 comprises a substrate 11*a* fixed to an insulator (not shown) and applied with a bias voltage, and brush fibers 11*b* of a low resistivity extending from the substrate 11*a* to form the operative edge at the tips of the fibers 11*b*. The substrate 11*a* may be made of a metal such as stainless steel, iron, copper, aluminum etc. or made of engineering plastics having a semi-conductive property.

The brush fibers 11*b* are made of conductive acrylic fiber having an electric resistivity on the order of $1\times10^4$ Ω−cm and 6.2 deniers in thickness in this example, and include a plurality of bundles of fibers each including 96 filaments arranged in a density of 100000 filaments/inch$^2$. The brush charger is, for exile, 132 mm long, 6 mm wide and 5 mm high. The brush fibers 11*b* may be formed instead from synthetic fiber such as polyprene, rayon, nylon, polyester, polycarbonate, and polyvinyl alcohol fiber.

The first changeover switch 34 selects the first negative voltage, −1150 volts, supplied from the first power source 31 or the ground voltage for the brush charger 11 based on a changeover signal supplied from the control unit 29. The ground potential may be replaced by a negative voltage which is smaller in absolute magnitude than the first negative potential. The second changeover switch 35 selects the positive voltage or the first negative voltage for the transcribing roller 22 based on a changeover signal supplied from the control unit 29. The developing roller 14 is selectively connected to the ground line (not shown in FIG. 2) or to the third power source 33 to be applied with the second negative voltage, −280 volts, during an image forming period, for electrifying the toner in negative potential.

Figure 3:
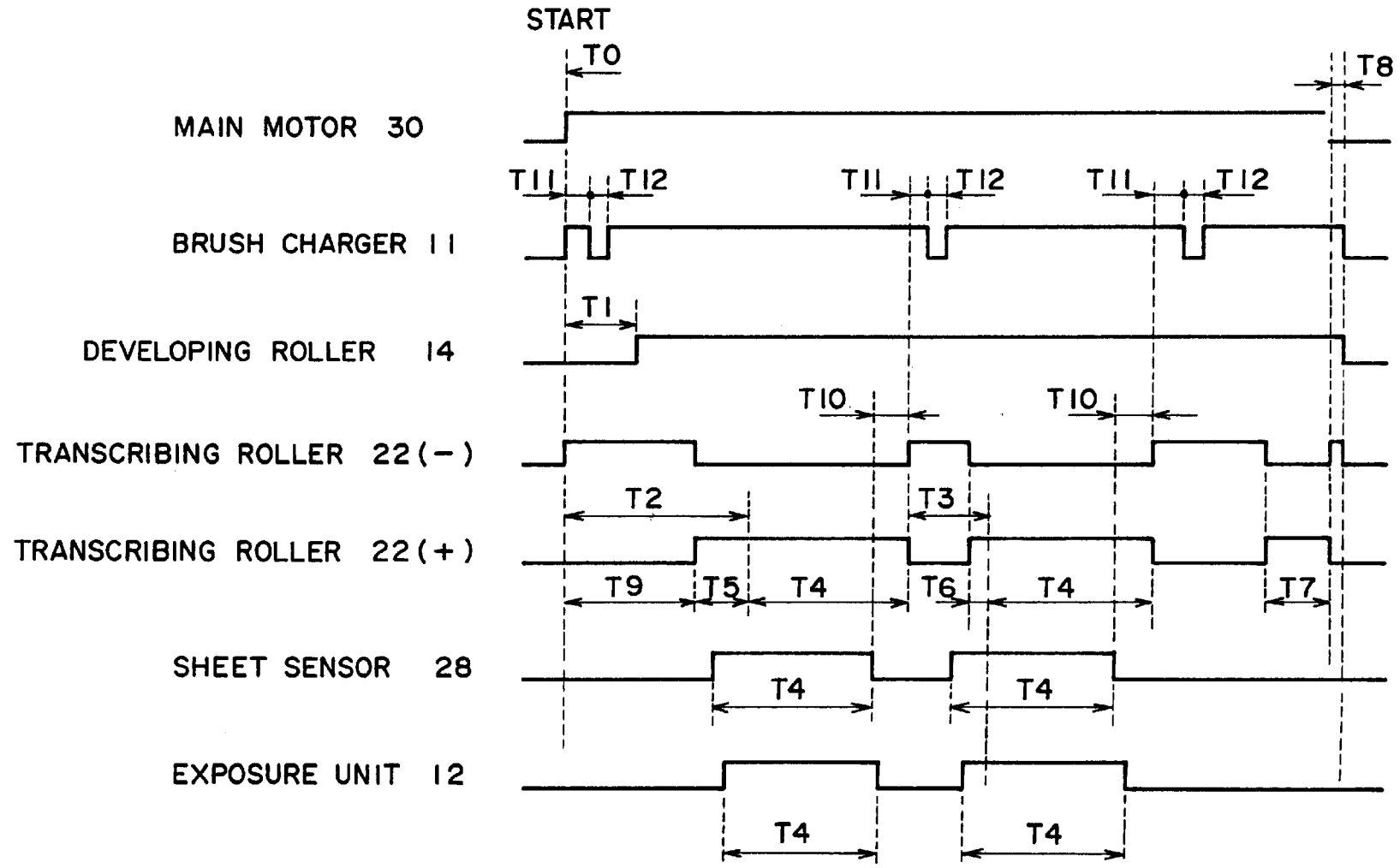
FIG. 3 is a timing chart for the imaging device of FIG. 2.

Referring to FIG. 3 additionally to FIGS. 1 and 2, the main motor 30 starts for driving the photoreceptor 20 at the start of the imaging device after T0 time is elapsed since the start switch (not shown) is closed for operation, wherein the time length T0 is detained by a rise time of the power source for supplying the bias voltage for the photoreceptor drum 20. As a result, the photoreceptor drum 20 starts to rotate at a constant speed. The control unit 29 outputs a changeover signal which allows the first changeover switch 34 to select the first negative voltage, −1150 volts, for the brush charger 11 and outputs another changeover signal which allows the second changeover switch 35 to select the first voltage for the transcribing roller 22. The developing roller 14 is maintained at the ground potential for the time length T1. In this state, the sheet sensor 28 and the exposure unit are off.

Figure 4:
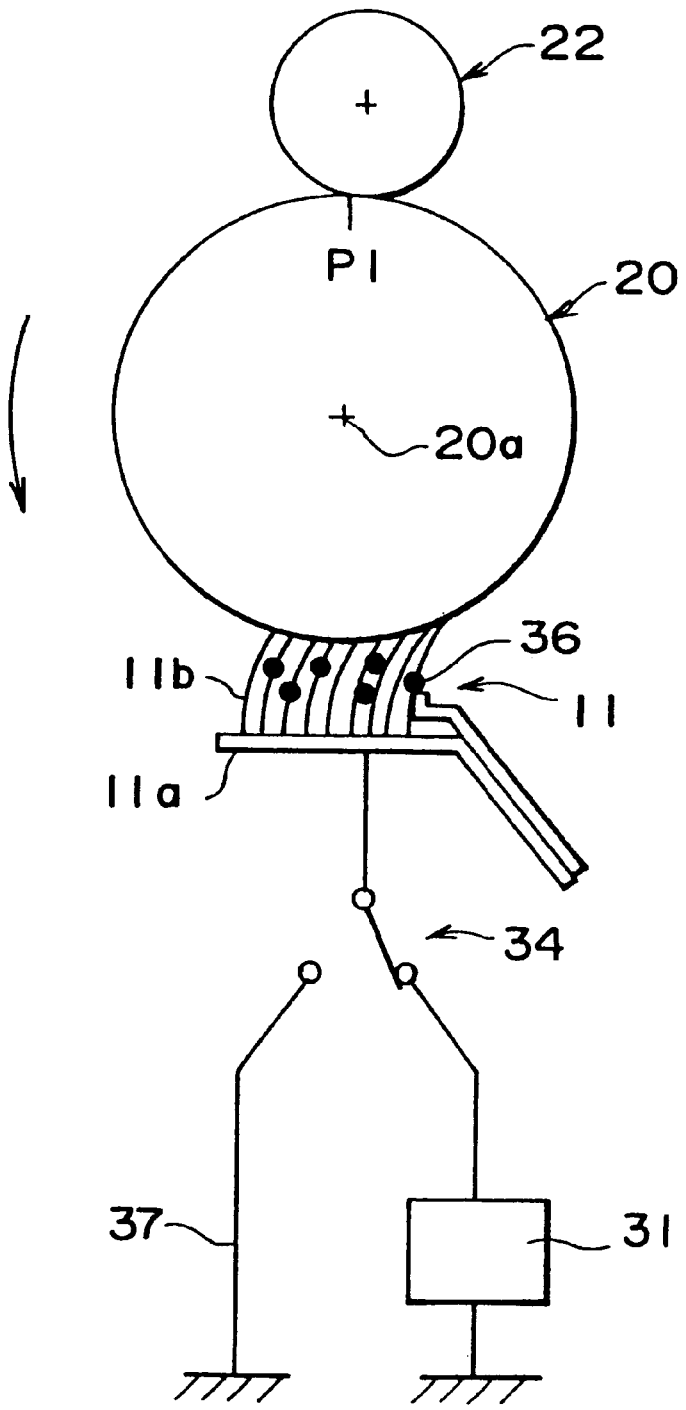
FIGS. 4 to 6 are schematic axial views of the imaging device of FIG. 1, for consecutively showing the position of the undesirable particles therein.
Figure 5:
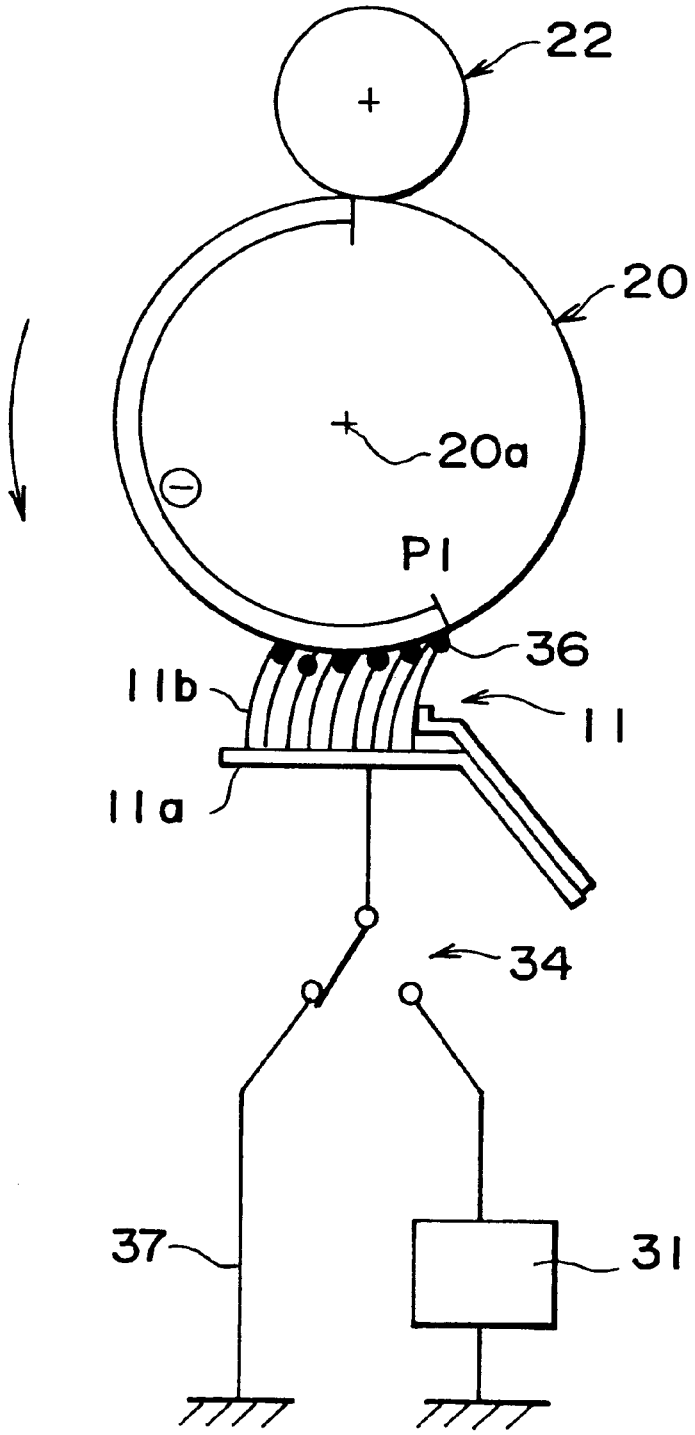

Referring additionally to FIG. 4, the photoreceptor drum 20 is applied with the first voltage by the transcribing roller 22 which functions as a main electrifying member, while the start position P1 of the photoreceptor drum 20 advances in the direction of the arrow. As a result, the photoreceptor drum 20 is electrified at a potential approximately −700 volts on the part of the surface of the photoreceptor drum 20 beginning from the start position P1 thereof. The photoreceptor drum 20 is applied with the first voltage until T11 time is elapsed since the start of the imaging device or until the start position P1 arrives at the brush charger 11 which functions as an auxiliary electrifying The control unit 29 then outputs a next hangeover signal which allows the first changeover switch 34 to select the ground potential, i e., the second voltage, for the brush charger 11 at the timing when the start position P1 arrives at the brush charger 11. The second voltage is selected to have the same polarity as the first voltage and is lower than the first voltage in the absolute magnitude, including the zero potential. By the second voltage, a small amount of undesirable particles 36 attached to the brush fibers 11*b* is attracted by an electric field toward the surface of the photoreceptor drum 20 which is applied with the first voltage, as shown in FIG. 5.

Figure 6:
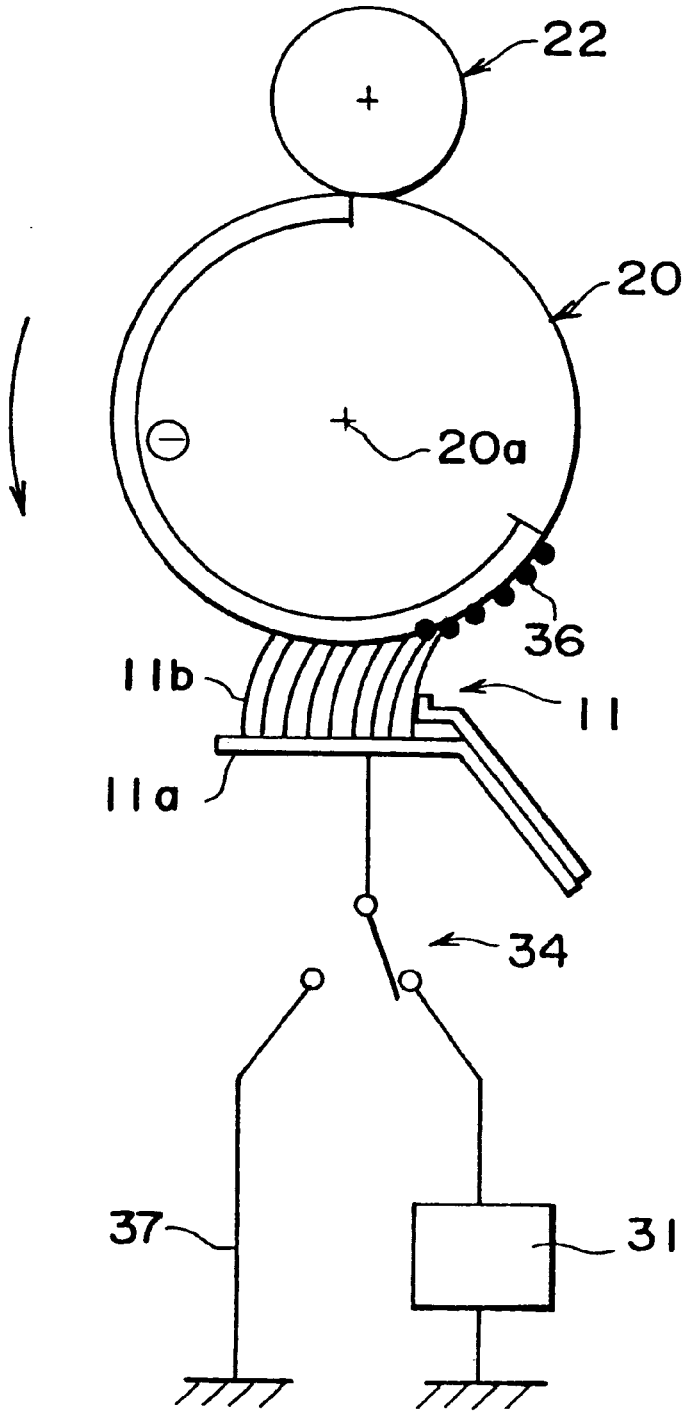

The photoreceptor drum 20 further rotates in the direction of the arrow as shown in FIG. 6, thereby effecting a brush charger cleaning step during time length T12 wherein the undesirable particles 36 having a positive voltage is removed from the brush charger toward the surface of the photoreceptor drum 20. The photoreceptor drum 20 transports the small amount of undesirable particles 36 by rotation thereof, and the undesirable particles 36 are later scratched away from the surface of the photoreceptor drum 20 by the scratch member 25 of the cleaner unit 26.

After the time T12 is elapsed for the brush charger cleaning step, the control unit 29 outputs a next changeover signal, which enables the first changeover switch to again select the first voltage, with the second changeover switch unchanged Subsequently, after the time T1 is elapsed since the start of the imaging device to allow the well-electrified portion of the photoreceptor drum 20 to arrive at the developing unit 19, the control unit 29 outputs a next changeover signal, which allows the developing roller 14 to be applied with a negative voltage, −280 volts, which electrifies the toner 17 in the same polarity, by connecting the developing roller 14 to the third power source 33.

When the portion of the electrified photoreceptor drum arrives at the transcribing roller 22 after the time length T9 is elapsed since the start of the imaging device, the control unit 29 outputs a next changeover signal, which allows the second changeover switch 35 to select the positive, third voltage for the transcribing roller 22. As a result, the positive-charged, undesirable particles 36 attached to the transcribing roller 22 are removed toward the surface of the photoreceptor drum 20, thereby effecting a transcribing roller cleaning step for the time length T5. The undesirable particles 36 are then transported by the photoreceptor drum 20 toward the cleaner unit 26 and removed thereby. In the configuration as described above, the transcribing roller 22 can be operated in a desirable state wherein the rear side of the recording sheet is substantially free from fog.

At a predetermined timing during the transcribing roller cleaning step, an exposure step starts wherein the portion of the photoreceptor drum 20 electrified by the brush charger 11 at a negative potential is irradiated by a laser beam emitted from the exposure unit 12 in accordance with a desired image data. As a result, an electrostatic latent image is formed on that portion of the drum surface by removing negative charge on the photoreceptor drum 20 by a laser pattern. At the timing of the end of the transcribing roller cleaning step, a recording sheet is introduced to the nip portion at which the photoreceptor drum 20 and the transcribing roller 22 pass the recording sheet, which takes place after the time length T2 elapsed since the start of the imaging device.

On the other hand, in the developing unit 19, the toner 17 received in the toner hopper 21 is supplied to the developing roller 14 by the toner supply roller rotating in the clockwise direction as viewed in FIG. 1, while being agitated by the agitating member 18 rotating in the counter-clockwise direction The developing roller 14 rotates in the counter-clockwise direction, and the toner supplied thereto is then electrified and uniformalized by friction with the toner blade 16 to obtain a uniform thin layer of the electrified toner attached to the surface of the developing roller 14. The electrified toner layer formed on the developing roller 14 is transferred by the rotating developing roller 14 to the contact portion between the developing roller 14 and the photoreceptor drum 20. The toner layer on the developing roller 14 is then transferred to the photoreceptor drum 20 in accordance with the electric field generated by the potential difference between the surface potential of the photoreceptor drum 20 and the bias voltage applied to the developing roller 14, thereby forming a toner pattern based on the desired image data.

The toner pattern transferred to the photoreceptor drum 20 is transported toward the transcribing roller 22 by the rotation of the photoreceptor drum 20. At this moment, the recording sheet 10 is introduced in synchrony with the rotation of the photoreceptor drum 20 to the nip portion between the photoreceptor drum 20 and the transcribing roller 22. Since the transcribing roller 22 is applied with the positive third voltage, a bias voltage having an opposite polarity with respect to the toner on the photoreceptor drum 20 is applied to the recording sheet from the rear surface thereof, thereby transcribing the toner pattern formed on the photoreceptor drum 20 toward the recording sheet 10. Subsequent rotation of the photoreceptor drum 20 enables the entire toner pattern to be transcribed onto the recording sheet 10. The recording sheet 10 is then moved toward the fixing unit 24, wherein the toner pattern is fixed onto the recording sheet 10. The time length for the sequence of the steps for recording the image onto one recording sheet as described above is T4. In the example shown in FIG. 3, two recording sheets are subjected in succession to the image recording by the imaging device.

Upon the end of recording the image onto the first recording sheet 10, the control unit 29 outputs another changeover signal which allows the second changeover switch to select the first voltage for the transcribing roller 22. The brush charger cleaning step is then repeated for the time length T12 with the surface of the photoreceptor drum 20 being electrified in a negative potential. After the second sheet is subjected to recording by the imaging device, similarly to the first sheet, the transcribing roller 22 is applied with the positive voltage for the time length T7, followed by stopping of the imaging device including the stop of the main motor.

The time lengths T0 to T12 employed in the present embodiment are, for example, as follows: T0=1000 nsec., T1=944 nsec., T2=2953–3558 nsec., T3=1020 nsec., T4=8980 nsec., T5=1689 nsec., T6=600 nsec., T7=1766 nsec., T8((margin)=10 nsec., T9=1600 nsec., T10=500 nsec., T11=700 nsec., and T12=200 nsec.

According to the imaging device of the present embodiment, the brush charger can be efficiently cleaned in the periodic brush charger cleaning steps. In particular, the electrification of the photoreceptor drum is effected by the combination of the brush charger and the transcribing roller, which prevents the reduction of the surface potential of the photoreceptor drum during the changeover of the switches. Moreover, the portion of the photoreceptor drum which passes the developing roller is less subjected to attachment or adherence of the toner, because the photoreceptor drum is electrified in the negative polarity which is same as the polarity of the charged toner.

A larger potential difference can be employed between the photoreceptor drum and the brush charger to effectively remove the undesirable particles from the brush charger. In a modified embodiment, separate power sources may be provided for applying the first voltage to the transcribing roller 22 and the brush charger 11.

By employing the brush charger cleaning step in the present embodiment, the reduction of the surface potential of the photoreceptor drum as well as the difference in the surface potential between the portions of the photoreceptor drum is lowered. Moreover, stripe pattern as occurred in the conventional imaging device due to the undesirable particles having a positive potential and attached to the brush charger is not observed in the present embodiment, whereby an excellent image is obtained Since the above embodiments are described only for examples, the present invention is not limited to the above embodiments and various modifications or alterations can be easily made therefrom by those skilled in the art without departing from the scope of the present invention.

What is claimed is:

1. An electrostatic imaging device comprising:

a rotating cylindrical photoreceptor drum;

a transcribing roller, disposed in operable relationship with said photoreceptor drum to form a nip portion therebetween for passing a recording sheet;

an exposure unit for irradiating said photoreceptor drum to form a latent image thereon during an image forming period;

a developing unit for supplying electrified toner to said photoreceptor drum to form a toner pattern;

a brush charger, disposed in operative relationship with said photoreceptor drum, for electrifying said photoreceptor drum during the image forming period; and a control unit for controlling an application of power from a first power source, said first power source applying a first voltage to said transcribing roller and said brush charger, said transcribing roller electrifying a predetermined point of said photoreceptor drum, said control unit controlling an application of power from a second power source, said second power source applying a second voltage to said brush charger when the predetermnined point of said photoreceptor drum rotates to said brush charger, said second voltage being lower in absolute magnitude than said first voltage and having a same polarity of said first voltage, thereby causing undesirable particles on said brush charger to migrate onto said photoreceptor drum, while said first voltage is maintained for said transcribing roller, wherein said control unit applies a third voltage to said transcribing roller after a brush cleaning step, for initiating a transcribing roller cleaning step, said third voltage having a polarity opposite to the polarity of said first voltage for causing undesirable particles on said transcribing roller to migrate onto said photoreceptor drum before a recording sheet is introduced to said nip portion, and wherein said first voltage is applied to said brush charger during said transcribing roller step.

2. An electrostatic imaging device as defined in claim 1 wherein said second voltage is a ground voltage.

3. An electrostatic imaging device as defined in claim 1, wherein an exposure step starts during the transcribing roller cleaning step, a portion of the photoreceptor drum being electrified by said brush charger and irradiated by a laser beam emitted from the exposure unit in accordance with a desired image data so that an electrostatic latent image is formed on the portion of the photoreceptor drum electrified by said brush charger.

4. An electrostatic imaging device comprising:

a rotating cylindrical photoreceptor drum;

a transcribing roller, disposed in operable relationship with said photoreceptor drum to form a nip portion therebetween for passing a recording sheet;

an exposure unit for irradiating said photoreceptor drum to form a latent image thereon during an image forming period;

a developing unit for supplying electrified toner to said photoreceptor drum to form a toner pattern;

a brush charger, disposed in operative relationship with said photoreceptor drum, for electrifying said photoreceptor drum during the image forming period; and a control unit for controlling an application of power from a first power source, said first power source applying a first voltage to said transcribing roller and said brush charger, said transcribing roller electrifying a predetermined point of said photoreceptor drum, said control unit controlling an application of power from a second power source, said second power source applying a second voltage to said brush charger when the predetermined point of said photoreceptor drum rotates to said brush charger, said second voltage being lower in absolute magnitude than said first voltage and having a same polarity of said first voltage, thereby causing undesirable particles on said brush charger to migrate onto said photoreceptor drum while said first voltage is maintained for said transcribing roller, wherein said control unit applies a third voltage to said transcribing roller after a final recording sheet is passed said nip portion between said photoreceptor drum and said transcribing roller, for initiating a transcribing roller step, and wherein said first voltage is applied to said brush charger during said transcribing roller step.

* * * * *

UNITED STATES PATENT AND TRADEMARK OFFICE

CERTIFICATE OF CORRECTION

PATENT NO. : 5,966,563
DATED : October 12, 1999
INVENTOR(S) : Mabumi KASHIHARA and Toshimi WATANABE It is certified that error appears in the above-identified patent and that said Letters Patent is hereby corrected as shown below:

| | | |
|---|---|---|
| Column 1, | line 57, | delete "charging" and insert --discharging--. |
| Column 3, | line 16, | delete "resect" and insert --respect--. |
| Column 3, | line 43, | delete "waging" and insert --imaging--. |
| Column 5, | line 39, | after "electrifying" insert --member.--. |
| Column 6, | line 8, | after "drum" insert --20--. |

Signed and Sealed this

Twenty-sixth Day of September, 2000

*Attest:*

Q. TODD DICKINSON

*Attesting Officer*

*Director of Patents and Trademarks*